US007666023B2

(12) United States Patent
Wu

(10) Patent No.: US 7,666,023 B2
(45) Date of Patent: Feb. 23, 2010

(54) ELECTRICAL CONNECTOR WITH A LATCH COUPLED TO A PULL MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/154,377

(22) Filed: May 22, 2008

(65) Prior Publication Data

US 2009/0291584 A1 Nov. 26, 2009

(51) Int. Cl.
*H01R 13/627* (2006.01)

(52) U.S. Cl. ..... 439/352; 439/358

(58) Field of Classification Search ..... 439/357, 439/484, 610, 483, 352, 358
See application file for complete search history.

(56) References Cited

U.S. PATENT DOCUMENTS 5,915,987 A 6/1999 Reed et al.
7,134,914 B1 11/2006 Wu
7,281,937 B2 10/2007 Reed et al.
2002/0072267 A1* 6/2002 Bowling et al. ..... 439/358
2006/0189197 A1* 8/2006 Reed et al. ..... 439/352
2008/0081511 A1* 4/2008 Lloyd et al. ..... 439/552

* cited by examiner

*Primary Examiner*—Chandrika Prasad
(74) *Attorney, Agent, or Firm*—Wei Te Chung; Andrew C. Cheng; Ming Chieh Chang

(57) ABSTRACT

An electrical connector (100) includes an elongated housing (1) having a base segment (1*a*) and a mating segment (1*b*); a latch mechanism (3) including a pull member (32) interlocking with a latch member (31), said pull member (32) assembled to a rear portion of the base segment and latch member (31) engaging with a front portion of the base segment, and said latch member further having at least a hook portion arranged on a front portion thereof and disposed above the mating segment. Movement of the pull member actuates the latch member bias upwardly to cause the hook portion apart from the mating segment.

10 Claims, 5 Drawing Sheets

ELECTRICAL CONNECTOR WITH A LATCH COUPLED TO A PULL MEMBER

BACKGROUND OF THE INVENTION

1. Field of the Invention

The present invention generally relates to an electrical connector, more particularly to an electrical connector with improved latching mechanism which is reliable and manipulated conveniently.

2. Description of Related Art

Small and low-profile connectors, such as those used in SFP (Small Form Factor Pluggable) applications are desired in electronic devices in which space is a premium. Such connectors are widely used to make connections with routers and servers. However, the connectors are tendential to unplug from the component of the aforementioned device.

Connectors, and particularly plug connectors, can be made more reliable and separation less likely by latching them together. U.S. Pat. No. 5,915,987 issued to Reed et al. on Jun. 29, 1999, entitled "Latched Electrical Connector", discloses a plug-receptacle connector assembly with a latching mechanism incorporated into the housing of the plug connector. One problem with the latching mechanism such as those disclosed in the Reed device are not usable with low-profile, high-density receptacle connectors. Their size and the side locations of the actuators for the latching mechanisms of such plug connectors would increase the size required in a system. Such connector also requires a specially configured housing to receive the plug connector. As connectors become smaller and as the density of receptacle connectors in electronic devices increases, the simple act of disengaging a plug connector latch mechanism becomes increasingly more difficult.

U.S. Pat. No. 7,281,937, issued to Reed et al. on Oct. 16, 2007 discloses a small, low-profile plug connector provides a latching mechanism, including a latching member with a pair of hooks that engage mating holes in a metal shell of an opposing connector, and which can be easily delatched from the opposing connector, by way of a simple ramp and lobe mechanism in the plug connector. The ramp and lobe mechanism converts horizontal movement of a pull tab-like actuator into vertical movement of a latching member such that the hooks are lifted upward and disengaged from the metal shell of the opposing connector. Enough and big pull force must be exerted to the actuator to make the hooks to be lifted upward to leave its original place. However, as there is no extra protection step, incorrect operation may cause the lobe mechanism being sandwiched between a top surface of the plug and the latching member, unable to restore automatically; furthermore, the latching member trend to be deformed, causing hooks unable to return its original place to lock with engage mating holes in a metal shell of the opposing connector.

U.S. Pat. No. 7,134,914 issued to Wu on Nov. 14, 2006 discloses a cable connector assembly introduces a latch mechanism assembled to a top surface of housing. The latch mechanism includes latching member having an engaging portion engaging with the housing and a latch portion extending forwardly from the engaging portion for be deflected in a vertical direction perpendicular to said front-to-back direction, so as to latch or unlatch with regard to the complementary connector; a pulling member assembled to the housing to actuate said latching member, and a shell located upon the housing and essentially vertically shielding the pulling member with a rear pulling portion of the pulling member exposed to an exterior. Wu device has spring-back member to push the latch mechanism restore and is convenient for user. However, there exists a tiny issue that the latching member and pulling member may trend to loose, thus the pulling member can not actuate the latching member precisely and reliably.

Hence, an improved latching mechanism of an electrical connector is highly desired to overcome the disadvantages of the related art.

SUMMARY OF THE INVENTION

Accordingly, an object of the present invention is to provide an electrical connector with improved latching mechanism which is durable and operated easily.

In order to achieve the object set forth, an electrical connector in accordance with the present invention comprises an elongated housing having a base segment and a mating segment; a latch mechanism including a latch member with a pull member attached thereto, the latch member engaging with a front portion of the base segment and having at least a hook portion arranged on a front portion thereof and disposed above the mating segment, and the pull member assembled to a rear portion of the base segment; and movement of the pull member actuating the latch member bias upwardly to cause the hook portion apart from the mating segment.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
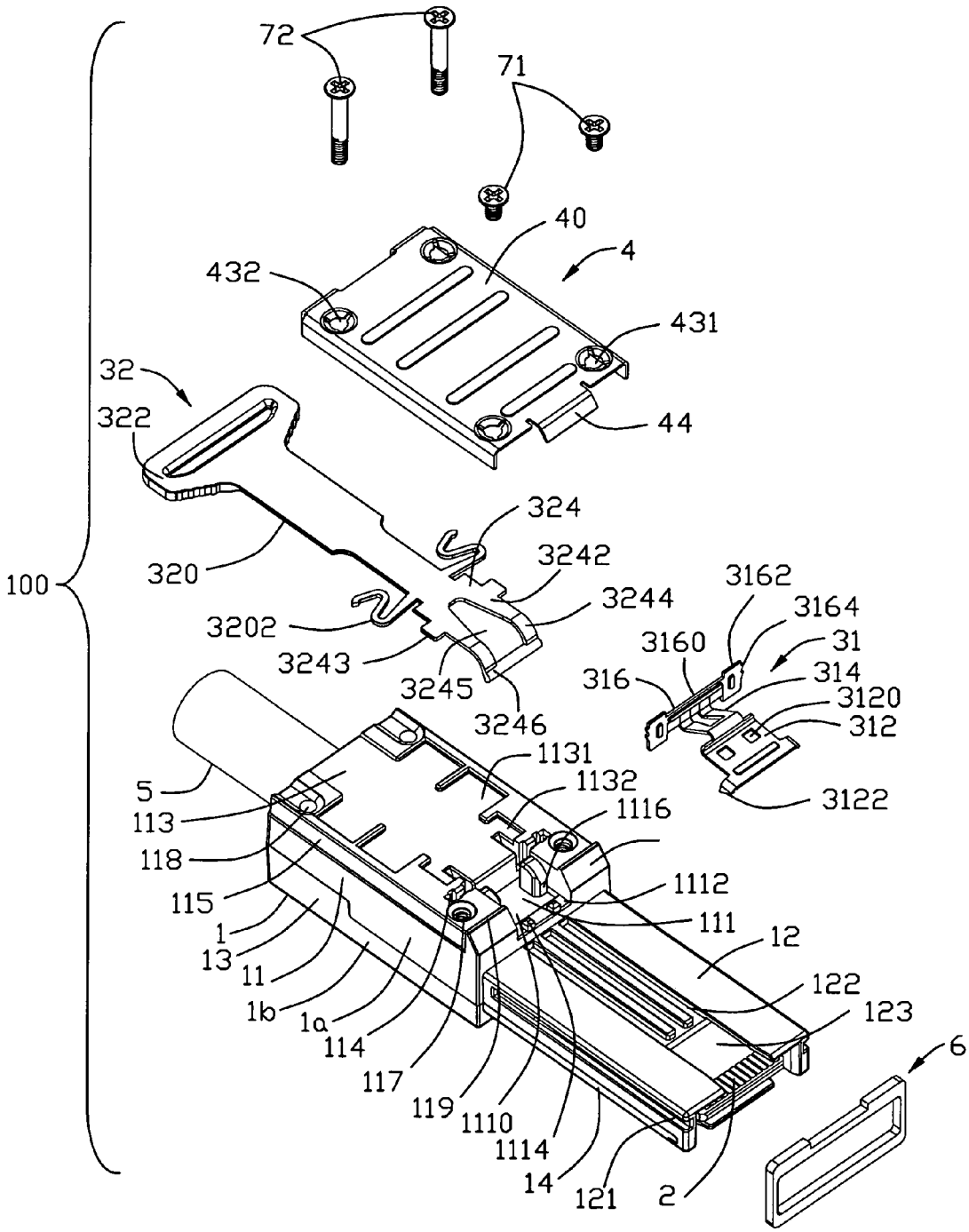
FIG. 1 is an exploded, perspective view of an electrical connector in accordance with the present invention.
Figure 2:
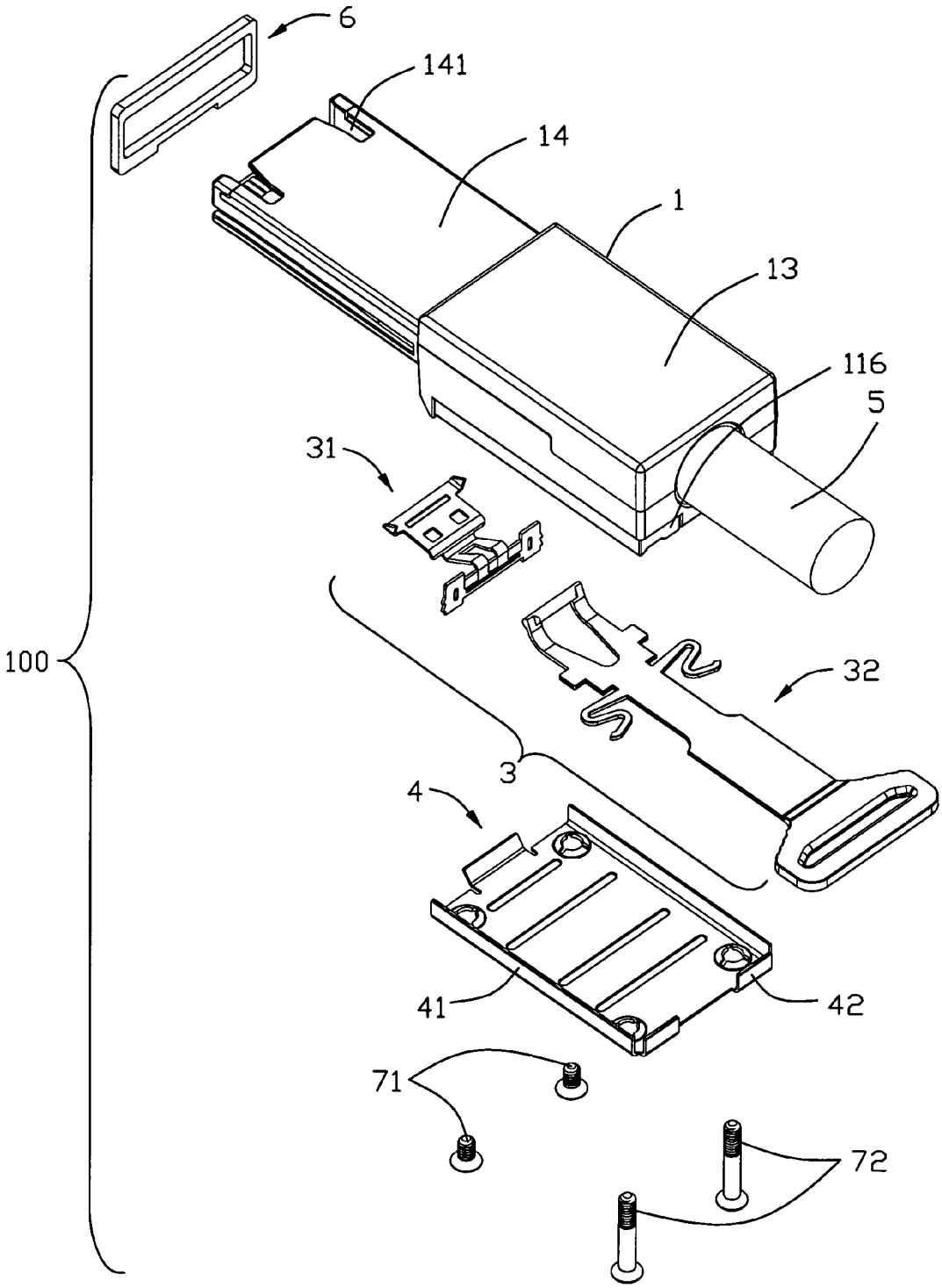
FIG. 2 is a view similar to FIG. 1, but viewed from another aspect.

Referring to FIGS. 1-2, an electrical connector comprises an elongated housing 1 enclosing a hollow portion 10 therein, a printed circuit board (PCB) 2 received in the hollow portion 10, a latch mechanism 3 assembled to the housing 1, a metal shell 4 partially covering the latching mechanism 3, a cable 5 coupled to rear end of the PCB 2, and an anti-EMI gasket 6.

The housing 1 includes a first piece 1*a* and a second piece 1*b* combined together to form the hollow portion 10. Both the first piece 1*a* and the second piece 1*b* are die-cast metal member.

The first piece 1*a* includes a base segment part 11 and a mating segment part 12 extending forward from lower front edge of the base segment part 11. A first cavity portion 111 is recessed downwardly from an upper surface of the base segment part 11 and located in a front portion of the base segment part 11. The first cavity portion 111 has a bottom surface 1110 and a front opening 1112 communicating outside. Two spaced protruding members 1114 are formed on the bottom surface 1110 and proximate to the front opening 1112. A pair of supporting members 1116 are respectively disposed in a rear portion of the first cavity 111 and arranged at lateral sides of the bottom surface 1110. Each supporting member 1116 has an inclined upper surface (not numbered). Two mounting slots 114 are recessed downward from the upper surface of the base segment part 11 and arranged two lateral sides of and communicate with the rear portion of the first cavity portion 111. A shallow channel portion or second cavity portion 113 is defined in a middle section of the upper portion of the base segment part 11, disposed at back of and communicating with the first cavity portion 111. Two laterally extended first recess portions 1131 are arranged at opposite sides of and communicate with a middle area of the channel portion 113. A pair of second recess portions 1132 are disposed in front of the first recess portions 1131 and communicate with the channel portion 113 too.

The mating segment part 12 includes a pair of first keyways 121 respectively arranged in transversal sides thereof, a front cutout 123 in a middle section of top side thereof and three juxtaposed keyways 122 at back of and communicating with the front cutout 123.

The second piece 1*b* includes a base segment part 13 and a mating segment part 14 extending forward from upper front edge of the base segment 11. A pair of narrow cutouts 141 are defined in a lateral side of front segment of the mating segment part 14.

The latch mechanism 3 includes a latching member 31 and a pull member 32 for actuating the latching member 31.

The latch member 31 includes a planar body portion 312, a vertical engagement portion 316 and an inclined connection portion 314 for connecting the body portion 312 and the engagement portion 316. The body portion 312 has a pair of downward hook portions 3122 formed at lateral sides of a front portion thereof. Two position holes 3120 is defined in a rear portion of the body portion 312. The engagement portion 316 has a transversal bar portion 3160 with two expanded wing portions 3162. Each wing portion 3162 further forms a number of barbs 3164 thereon.

The pull member 32 comprises a main body 320, a pull portion 322 extending rearward from end of the main body 320 and an actuator portion 324 extending forwardly from front of the main body 320. The main body 320 has an elongated body portion, with a pair of spring-back claws 3202 arranged at lateral sides of the front thereof. The actuator portion 324 includes a horizontal portion 3242 and a downwardly inflected portion 3244. A triangular-shaped mounting hole 3245 is defined in the middle section of the actuator portion 324. A pair of stop members 3243 extend laterally from the horizontal portion 3242, and a cam member 3246 is formed on front end of the inflected portion 3244.

The metal shell 4 includes a planar top wall 40, a pair of transversal walls 41 extending downwardly from lateral edges of the top wall 40 and a back wall 42 extending downwardly from rear edges of the top wall 40. The back wall 42 defines a rectangular-shaped outlet 421 in the middle section thereof. A spring member 44 extends forwardly from front section of the top wall 40.

Figure 3:
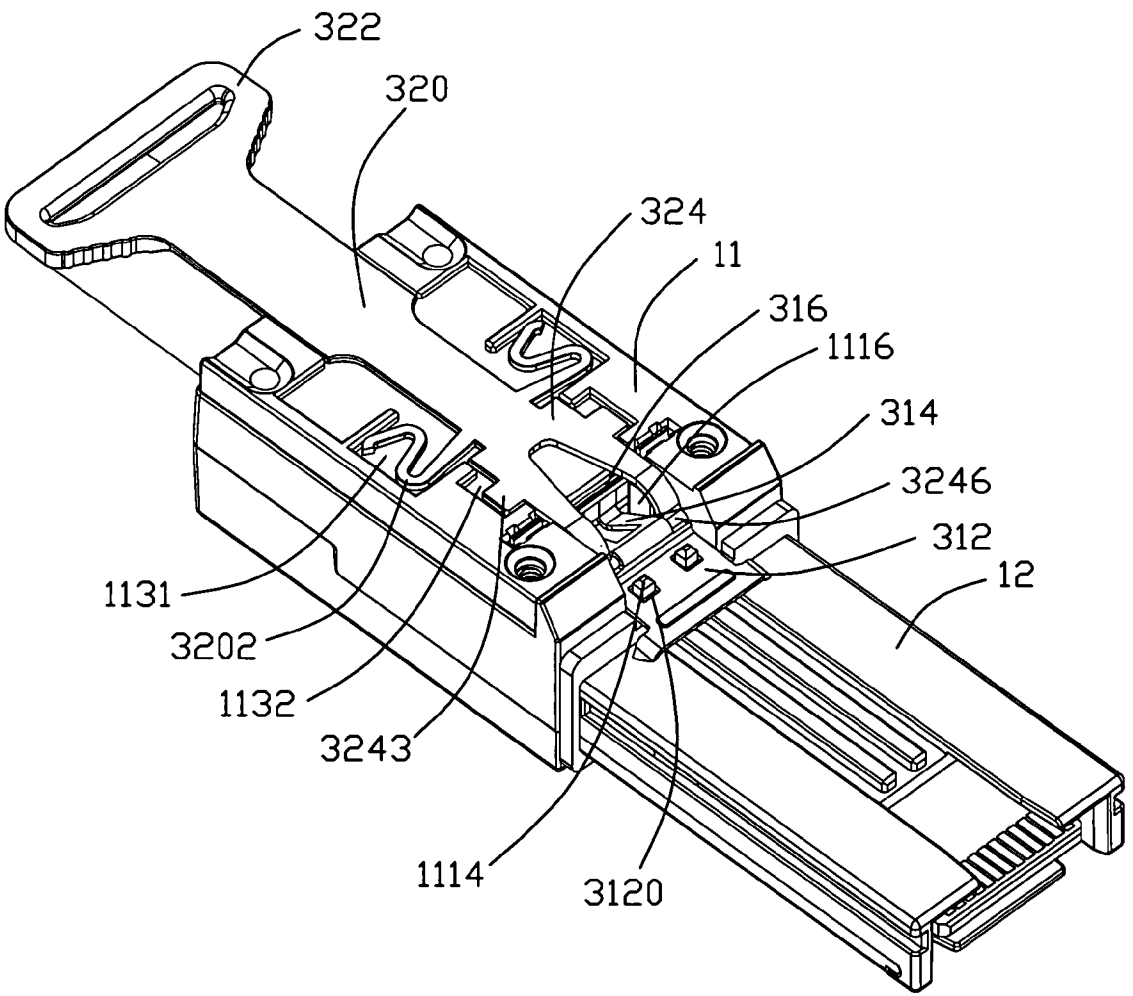
FIG. 3 is a partially assembled, perspective view of the electrical connector shown in FIG. 1.
Figure 4:
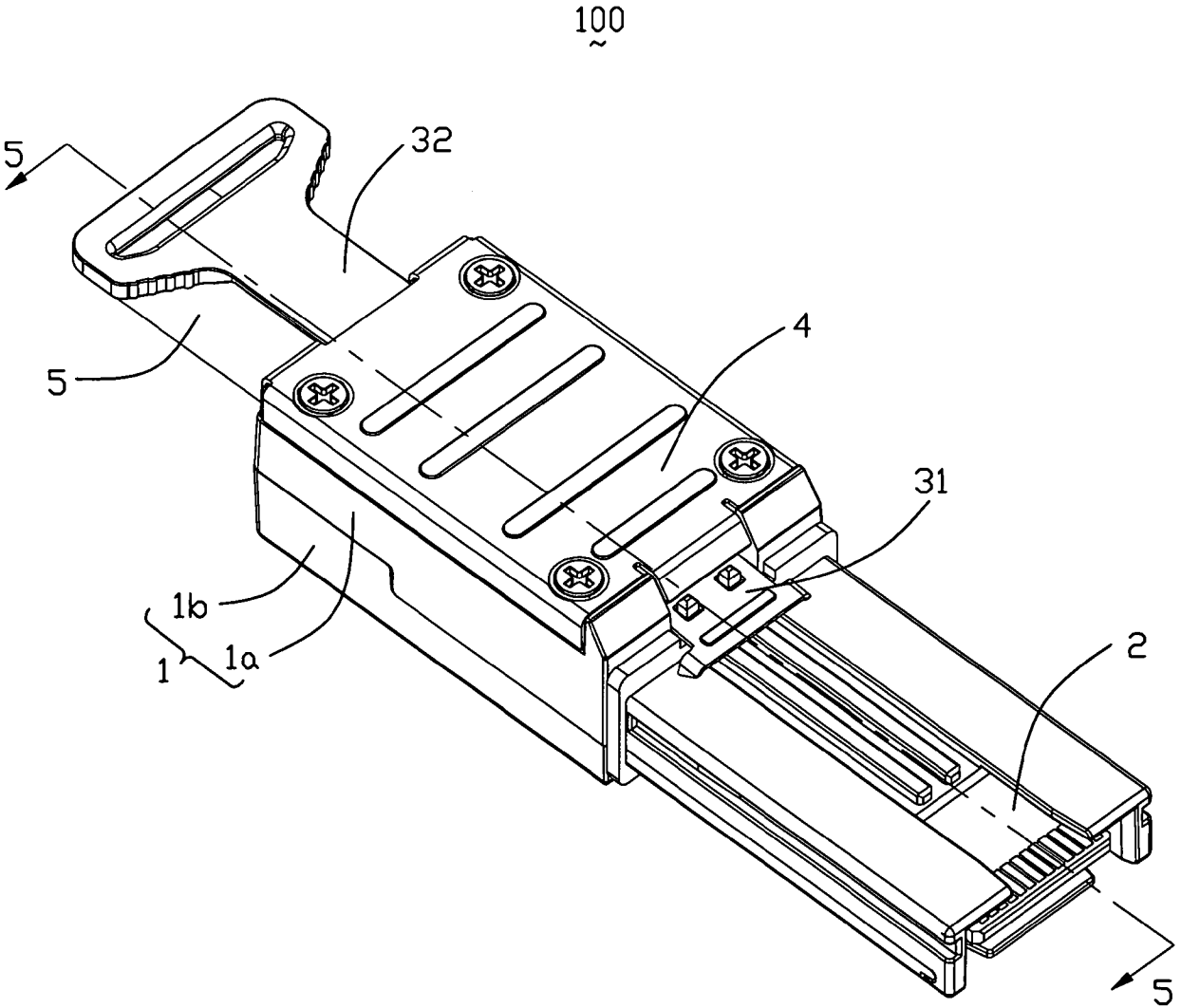
FIG. 4 is an assembled, perspective view of the electrical connector shown in FIG. 1.
Figure 5:
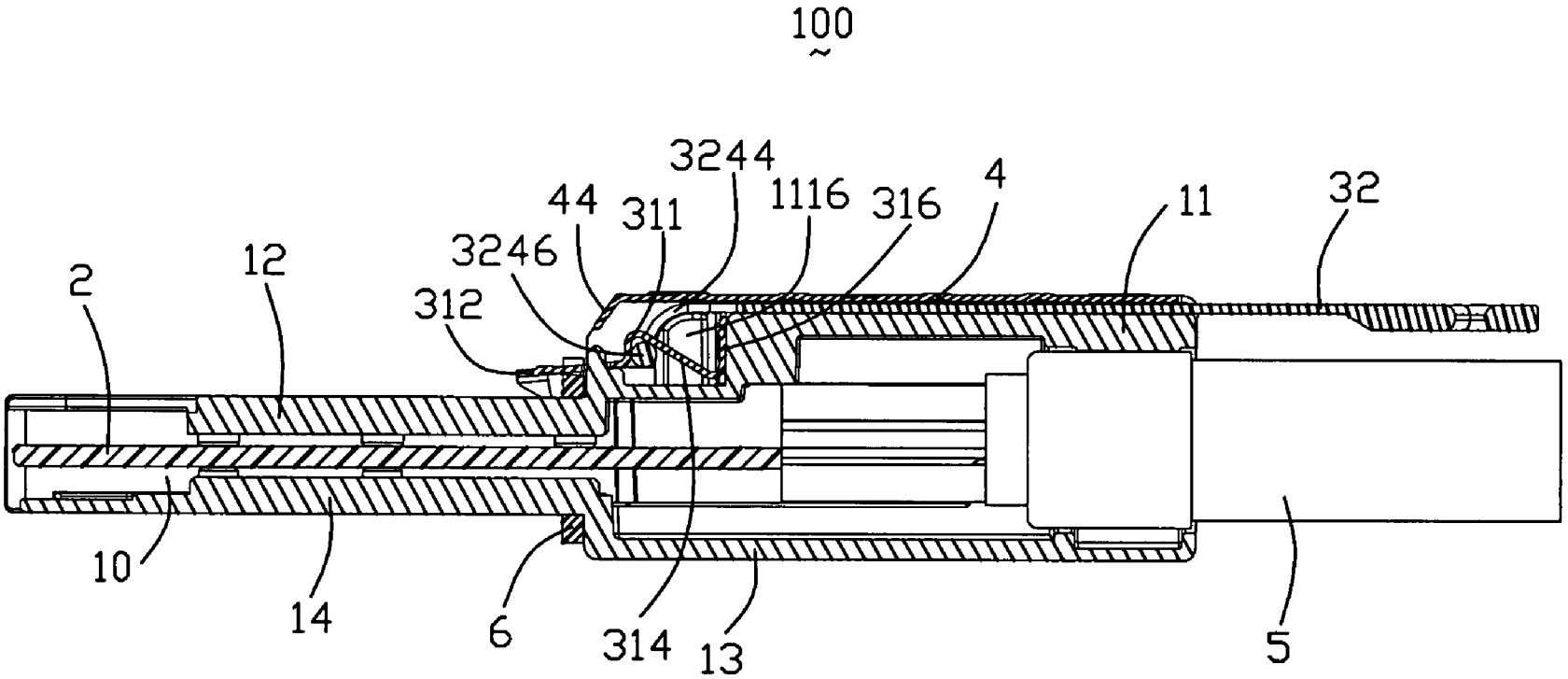
FIG. 5 is another cross-section view taken along line 5-5 of FIG. 4.

Referring to FIGS. 3-5, in conjunction with FIGS. 1-2, when assemble, the engagement portion 316 of the latch member 31 is interposed into the mounting hole 3245 of the actuator portion 324, and after moderate adjusted, the transversal bar portion 3160 is disposed below the horizontal portion 3242 of the actuator portion 324, and the cam member 3246 is arranged below underside of the connection portion 314 of the latch member 31. Therefore, the latch member 31 is attached/fastened to the pull member 32, such structure may insure that the two members are combined together reliably, furthermore, the pull member 32 may actuate the latch member 31 more efficiently.

The pull member 32 is assembled to the first piece 1*a*, with the main body 320 accommodated in the channel portion 113, the stop members 3202 extending into the first recess portions 1131, the stop members 3243 extending into the second recess portion 1132, the inflected portion 3244 disposed in the first cavity portion 111 and riding against the pair of supporting members 1116.

The latch member 31 is mounted to the first piece 1*a*, with the rear portion of the body portion 312 accommodated in the front portion of the first cavity portion 111, the pair of protruding members 1114 inserted into the two position holes 3120, the front portion of the body portion 312 disposed above the top side of the mating segment part 12 and the pair of hook portions 3122 proximate to a top surface of the mating segment part 12. The connection portion 314 is arranged in the rear portion of the first cavity portion 111 and lie between the pair of supporting members 1116. The engagement portion 316 is disposed at back end of the first cavity portion 111, with the pair of wing portions 3162 interferentially received in the two mounting slots 114.

Finally, the metal shell 4 is assembled to the housing 1, with the pair of transversal walls 41 and the back wall 42 arranged in a pair of notches 115 defined in two lateral and another notches 116 defined in a rear side of the base segment part 11, a front edge of the metal shell 4 abutting against a pair of ridge portions 119 in the front of the housing 1, the spring member 44 substantially pressing onto the body portion 312 of the latching member 31, a rear portion of the main body 320 exiting outwardly through the outlet 421 of the rear wall 42, with the pull portion 322 disposed outward. A pair of first screws 71 and another pair of second screws 72 pass through a pair of first through holes 431 and another pair of second through holes 432 of the top wall 40 of the metal shell 4, inserted into corresponding screw holes 117, 118 of the base segment parts 11 and 12 to combine the metal shell 4 and the housing 1 together.

When the electrical connector 100 mates with an opposing connector (not shown), the hook portions 3122 of the latching member 31 locking into mating holes in a metal shell of an opposing connector, to keep them combining together reliably. When the electrical connector 100 disengages the opposing connector, a pull force exerted onto the pull portion 322 to cause the actuator portion 324 moving rearward, with the cam member 3246 sliding along the pair of supporting members 1116 to urge the connection portion 314 retracting backward, thus, the body portion 312 of the latch member 31 is elevated. Therefore, the hook portions 3122 are lifted to disengage the mating holes of the metal shell of the opposing connector. When the pull force is released, the spring member 44 presses onto the latching member 31 to make it return to an original place, the spring-back claws 3202 of the pull member 32 offer a restore force to push it return to an original place. The stop members 3243 only slide in the second recess portions 1132 to inhibit the pull member 32 rearward moving excessively.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an elongated housing having a base segment and a mating segment;

a latch mechanism including a latch member physically linked with a pull member, the latch member engaging with a front portion of the base segment and having at least a hook portion arranged on a front portion thereof and disposed above the mating segment, and the pull member assembled to a rear portion of the base segment; and movement of the pull member actuating the latch member bias upwardly to cause the hook portion apart from the mating segment; wherein the pull member has a main body and an actuator portion extending forwardly from the main body;

wherein the latch member includes a body portion, an engagement portion and an inclined connection portion, wherein the connection portion is interposed into a mounting hole of the actuator portion, with the engagement portion and the body portion disposed at opposite sides of the actuator portion;

wherein the inclined connection portion extends from a bottom edge of the engagement portion; wherein a first cavity portion is recessed downwardly from an upper surface of the base segment and located in a front portion of the base segment; wherein an inflected portion is formed at a front portion of the actuator portion and accommodated in the first cavity portion; wherein a pair of spaced supporting members are disposed in a rear portion of the first cavity portion, wherein the inflected portion of the actuator portion ride against the supporting members.

2. The electrical connector as claimed in claim 1, wherein the engagement portion of the latch member is disposed in a rear end of the first cavity portion and engage with the base segment, wherein the connection portion of the latch member is arranged between the pair of supporting members.

3. An electrical connector, comprising:

an elongated housing having a base segment and a mating segment extending forwardly form the base segment;

a latch mechanism having a pull member and a latch member fastened together and mounted to the housing, the latch member being undetachable from the pull member;

a metal shell assembled to the housing to partially shield the latch mechanism, with a front portion of the latch member disposed aside the mating segment; and movement of the pull member causing the front portion of the latch member deflected from the mating segment;

wherein the base segment defines a first cavity portion in a front portion thereof and a channel portion located in a rear portion of the base segment and communicating with the first cavity portion;

wherein the pull member includes a main body received in the channel portion and an actuator portion connecting with the main body and extending into the first cavity portion;

wherein the actuator portion includes a horizontal portion received in a front portion of the channel portion and a downwardly inflected portion extending into the first cavity portion;

wherein a pair of spaced supporting members arranged in rear portion of the first cavity portion;

wherein the inflected portion of the actuator portion rides against the pair of supporting members.

4. The electrical connector as claimed in claim 3, wherein the latch member has an engagement portion engaging with the base segment, a body portion forwardly extending through a front opening of the first cavity portion and an inclined connection portion disposed between the pair of supporting members and connecting the engagement portion and the body portion.

5. The electrical connector as claimed in claim 4, wherein a mounting hole is defined in the actuator portion, with the inclined connection portion of the latch member passing through therein, and a cam member is formed at a front end of the inflected portion, disposed below underside of the inclined connecting portion.

6. An electrical connector comprising:

a casing defining a mating segment and a base segment;

a latch mechanism including a latch member and a pull member, the latch member being essentially of a cantilever manner with a rear retention section retained to the base segment, a front hook moveable around the mating segment, and an inclined connection section linked between the rear retention section and the front hook section, the pull member being restricted to move along a front-to-back direction only and including a rear handle portion and a front cam member with a mounting hole thereabouts so as to allow the inclined connection section pass therethrough, thus the rear retention section being essentially positioned under the pull member while the inclined connection section being positioned above the cam member of the pull member in an interwoven manner, wherein the cam member moveably abuts against an underside of said inclined connection section; wherein the cam member continuously extends along a transverse direction to seal the mounting hole in said front-to-back direction.

7. The electrical connector as claimed in claim 6, wherein the casing essentially defines opposite larger upper and bottom faces and opposite smaller side faces between said upper and bottom faces wherein all the pull member is essentially located on and extends along said larger upper face.

8. The electrical connector as claimed in claim 7, wherein the pull member includes a spring claw between the front cam member and the rear handle.

9. The electrical connector as claimed in claim 6, wherein the pull member further includes an inflected portion linked behind the cam member, said inflected portion raises the cam member to lift the corresponding inclined connection portion when the pull member is moved rearwardly due to engagement between the inflected portion and a supporting member formed on the base segment.

10. The electrical connector as claimed in claim 6, wherein the pull member id deflectable around said mounting hole.

* * * * *